US005219028A

United States Patent [19]

Martin et al.

[11] Patent Number: 5,219,028

[45] Date of Patent: Jun. 15, 1993

[54] WELL CASING AND WELL CASING METHOD

[75] Inventors: James W. Martin, Missouri City; Edward G. Dew, Woodlands, both of Tex.

[73] Assignee: Conoco Inc., Ponca City, Okla.

[21] Appl. No.: 842,027

[22] Filed: Feb. 25, 1992

[51] Int. Cl.[5] ..... E21B 19/16

[52] U.S. Cl. ..... 166/380; 166/386; 166/73; 166/115; 166/236; 166/242

[58] Field of Search ..... 166/380, 386, 387, 69, 166/73, 115, 208, 317, 235, 236, 242

[56] References Cited

U.S. PATENT DOCUMENTS

| | | | |
|---|---|---|---|
| 2,224,630 | 12/1940 | Dean et al. . | |
| 3,071,193 | 1/1963 | Raulins | 166/332 |
| 3,255,821 | 6/1966 | Curlet | 166/380 |
| 3,385,367 | 5/1968 | Kollsman | 166/387 X |
| 3,386,510 | 6/1968 | Schnabel, Jr. . | |
| 3,529,667 | 9/1970 | Malone | 166/387 |
| 3,661,207 | 5/1972 | Current et al. | 166/317 X |
| 3,880,233 | 4/1975 | Muecke et al. . | |
| 4,498,543 | 2/1985 | Pye et al. . | |
| 5,156,220 | 10/1992 | Forehand et al. | 166/386 |

*Primary Examiner*—Ramon S. Britts
*Assistant Examiner*—Roger J. Schoeppel
*Attorney, Agent, or Firm*—A. Joe Reinert

[57] ABSTRACT

The present invention provides a preperforated casing for a well bore and a method of installing a preperforated casing in a well bore. The inventive casing comprises (a) a conduit having a plurality of apertures extending through the wall thereof and (b) a liner fixed adjacent at least a portion of the interior surface of the conduit such that the liner is positioned adjacent the apertures and is operable for preventing fluid flow through the apertures. The liner is removable from the conduit by drilling. Additionally, the liner comprises a material which, upon drilling, will break up into pieces which can be readily circulated out of the well. The inventive method comprises the steps of running the inventive casing into a well bore and then drilling the liner such that the liner is broken up into pieces and the above-mentioned apertures are open for fluid flow.

31 Claims, 2 Drawing Sheets

WELL CASING AND WELL CASING METHOD

FIELD OF THE INVENTION

In one aspect, the present invention relates to well casings. In another aspect, the present invention relates to methods of installing preperforated casings in wells. In yet another aspect, the present invention relates to methods of installing preperforated casings in high deviation wells.

BACKGROUND OF THE INVENTION

Wells (e.g., oil wells, gas wells, injection wells, water wells, etc.) are commonly formed by a process wherein a drilling apparatus is used to drill a well bore from the earth's surface to at least one subterranean formation. A typical drilling apparatus will include a tubular drill string having a drill bit positioned on the end thereof. Throughout the drilling process, a circulating fluid (e.g., a drilling mud) is typically pumped down the drill string and through the drill bit. After flowing through the drill bit, the circulating fluid flows up the well via an annulus defined between the wall of the well bore and the outer surface of the drill string. Among other things, this flow of circulating fluid assists the drilling process and carries drill cuttings out of the well.

Upon completion of the drilling process, the drilling apparatus is typically removed from the well bore and the well is cased. A well is cased by running a casing (i.e., a sturdy tubular conduit) into the well bore. Once in place, the casing prevents the well bore from collapsing and facilitates the performance of various downhole processes.

While inserting a casing into a well bore, it is sometimes necessary to pump a circulating fluid (e.g., a drilling mud or a completion fluid) out of the lower-most end of the casing. Before the casing is inserted into the well bore, portions of the well bore may collapse and/or shrink. However, by pumping a circulating fluid out of the end of the casing, and by rotating the casing as necessary, obstructions, such as those created by well bore shrinkage and/or partial well bore collapse, can oftentimes be cleared from the path of the casing so that the casing is enabled to descend into the well bore. As these obstructions are cleared, the circulating fluid also carries the resulting debris out of the well via an annulus defined between the wall of the well bore and the outer surface of the casing.

As is well known in the art, a high deviation well, e.g., a horizontally completed well, can be drilled when it is desirable to obtain a well bore which is not strictly vertical. As used herein and in the claims, the term "high deviation well" refers to any well having a well bore which is intentionally drilled such that one or more portions of the well bore are nonvertical. A high deviation well bore can be drilled, for example, when it is desirable to direct the well bore around, to, or through a given formation. The term "horizontally completed well", as used herein, refers to a well wherein the well bore has been drilled to include one or more substantially horizontal sections.

Subterranean formations, although typically very thin, can extend great distances horizontally. Thus, although the well bore of a strictly vertical well can extend only a few feet through a typical thin formation, a horizontally completed well can include one or more horizontal well bore sections which extend several hundred or several thousand feet through the formation. By providing much greater contact between the well bore and the formation, the horizontally completed well will typically provide a higher production rate than is provided by the strictly vertical well.

The installation of a well casing is particularly desirable when the well in question is a high deviation well. The installation of a well casing is especially desirable when the well in question is a horizontally completed well. Unless a casing is installed in the well bore of a high deviation well, the nonvertical portions of the well bore, and particularly any substantially horizontal portions of the well bore, are highly susceptible to cave-ins.

Methods of drilling high deviation wells are well known in the art. Such methods typically involve the use of a double acting drill bit assembly which: (a) drills along a substantially linear path when the drill stem is rotated and a circulating fluid is pumped through the drill bit assembly and (2) drills along an arcuate path when a circulating fluid is pumped through the drill bit assembly but the drill stem is not rotated.

In order to place a cased well in fluid communication with a subterranean formation through which the well casing runs, the Casing must be perforated. Typically, a casing is perforated after it is installed in the well bore. However, the process of perforating a casing after the casing is installed in the well bore can be time consuming and extremely expensive, particularly when the well in question is a horizontally completed well. In order to obtain the above-mentioned benefits of horizontal completion, at least one long horizontal section of casing must typically be placed in fluid communication with a subterranean formation through which said horizontal section of casing extends. Consequently, perforations must be formed along substantially the entire length of the horizontal section.

A need presently exists for (1) a useful, preperforated well casing and for (2) an effective and efficient method of installing a preperforated casing in a well. These are not adequately provided by merely perforating a casing aboveground and then inserting the perforated casing into the well bore. As indicated above, it is sometimes necessary to pump a circulating fluid out of the end of the casing as the casing is inserted into the well. Further, in order to remove drilling mud filter cake from the walls of the well bore and to remove unwanted fluids from the well bore, it is also desirable to pump a circulating fluid out of the end of the casing after the casing has been positioned in the well bore. If, however, even a few unsealed perforations are present in the wall of the casing during these circulating operations, a large quantity of circulating fluid will flow out of the perforations rather than through the end of the casing. Consequently, the amount of circulating fluid flowing out of the end of the casing typically will not be sufficient to accomplish the above-mentioned objectives.

A need also exists for (1) a useful, preperforated casing which can be installed in a well bore as the well bore is being drilled and (2) an efficient and effective method for installing a preperforated casing in a well bore as the well bore is being drilled. Until a casing is installed therein, a well bore is vulnerable to those forces which can cause the wall of the well bore to collapse. As indicated above, the danger of collapse is particularly great in the case of high deviation wells and is especially great in the case of horizontally completed wells. However, if a preperforated casing could be successfully installed at the same time that the well is being drilled, the danger of well bore collapse would be substantially eliminated. Additionally, the successful installation of this preperforated casing would eliminate the need to perform subsequent downhole perforation operations.

U.S. Pat. No. 2,224,630 issued to Dean et al. discloses a liner which is simply lowered into an oil or water well which has already been cased. The liner includes a preperforated screen. A portion of the preperforated screen remains open as the liner is lowered into the well casing. The remainder of the preperforated screen is covered with a thin layer of cement. Dean et al. further disclose a process including the steps of: (a) lowering the liner into the well casing until it reaches a predetermined depth; (b) depositing a gravel pack around the bottom exterior portion of the screen by pumping a gravel filled drilling mud solution down the annulus defined between the interior surface of the casing and the exterior surface of the liner; and (c) after the gravel pack is deposited, drilling through the thin cement layer in order to open the remainder of the screen.

Due to the high material density of cement, the cement debris produced by drilling a cement coating of the type described by Dean et al. is not easily circulated out of the well. Any cement debris remaining in the well can cause the drilling tool, or any other tool which is later inserted into the well, to become stuck in the well. Additionally, cement coatings of the type described by Dean et al. are difficult to install, particularly when long screen lengths are involved. Further, due to their low strength, cement coatings of the type described by Dean et al. are typically highly susceptible to cracking and breakage during shipping, handling, and installation.

U.S. Pat. No. 4,498,543 issued to Pye et al. discloses the insertion of a preperforated liner into a cased well. The lower end of the liner is closed, thus preventing the performance of circulation operations while the liner is being inserted and/or after the liner is inserted. The holes of the Pye et al. liner are temporarily sealed with hollow plugs. Each plug has an open flanged outside portion, which is urged against the outside surface of the liner, and a closed inner end which projects into the interior of the Pye et al. liner. When the liner is positioned in the well, a cutting tool is run down the inside of the liner in order to sever the closed ends of the plugs and thus open the perforations for fluid flow.

Plugged perforation systems of the type disclosed by Pye et al. produce various undesirable plug parts which, due to their size, shape, and material density, are very difficult to circulate out of a well. Thus, these plug parts deposit in the well and present obstructions which can cause the cutting tool, or a later inserted tool, to become stuck in the well. As is also apparent, the amount of trash (i.e , plug parts) deposited in the well will increase as the number of plugged perforations increases.

U.S. Pat. No. 3,386,510 issued to Schnabel, Jr. discloses a well point pipe having a strainer portion and a continuous, uniform, noncircular transverse cross section. The well point pipe is drilled into the ground by turning the pipe and applying downward pressure thereto while simultaneously jetting water through the end of the well point pipe. The strainer portion of the well point pipe is temporarily sealed with a sleeve. The sleeve is composed of a material which is insoluble in cold water (i.e., less than 100° F.) but is highly soluble in warm water (i.e., at least 150° F.). Thus, when the well point pipe is in place, the screen is removed by pumping warm water down the pipe. Several of the Schnabel, Jr. well point pipes are drilled down around the circumference of an excavation and are used to prevent water from flowing into the excavation. However, due to its noncircular (preferably square) cross section, the Schnabel, Jr. well point pipe is not suited for use as a casing for a well bore of any substantial depth. Further, due to the high temperature conditions existing downhole in deeper wells (e.g., in common oil or gas wells), the soluble sleeve portion of the Schnabel, Jr. device would dissolve before the Schnabel, Jr. pipe could be fully lowered into the well bore.

SUMMARY OF THE INVENTION

The present invention provides a novel casing for a well. The casing comprises: (1) a conduit having a plurality of apertures extending through the wall thereof, an interior surface, and a cylindrically-shaped exterior surface and (2) a liner fixed adjacent at least a portion of said interior surface such that the liner is positioned adjacent to said apertures and the liner is operable for preventing fluid flow through the apertures. The liner is removable by drilling. Further, the liner comprises a material which, upon drilling, will break up into pieces which can be readily circulated out of the well.

The present invention also provides a novel method of installing a perforated casing in a well having a well bore. The perforated casing used in this method comprises: (1) a conduit having a plurality of apertures extending through the wall thereof and an interior surface and (2) a liner fixed adjacent at least a portion of said interior surface such that the liner is positioned adjacent the apertures and the liner is operable for preventing fluid flow through the apertures. The novel method comprises the steps of (a) running the perforated casing into the well bore, (b) drilling said liner such that the liner is broken up into pieces and said apertures are opened for fluid flow, and (c) circulating the pieces out of the well bore using a circulating fluid.

Additionally, the present invention provides a novel method of installing a perforated casing in a well having a high deviation well bore. The perforated casing used in this method comprises: (1) a conduit having a plurality of apertures extending through the wall thereof and an interior surface and (2) a liner fixed adjacent at least a portion of said interior surface such that the liner is positioned adjacent said apertures and the liner is operable for preventing fluid flow through the apertures. This method comprises the steps of: (a) running the perforated casing into the well bore and (b) drilling said liner such that the liner is broken up into pieces and the apertures are open for fluid flow.

The present invention alleviates the problems and achieves the objectives identified hereinabove. Although the casing of the present invention is preperforated (i.e., perforated prior to being inserted into the well bore), a circulating fluid can be readily pumped out of the lowermost end of the casing throughout the entire casing installation process. Also, the liner used in the inventive casing can be quickly and easily installed. Additionally, the liner used in the inventive casing can readily be drilled away from the interior surface of the casing and then circulated out of the well without damaging either the casing or the formation. Further, the inventive preperforated casing can be installed in a vertical well or a high deviation well. Additionally, the inventive preperforated casing can be installed while the well bore is being drilled.

Thus, the present invention provides a useful, preperforated casing and effective and efficient methods for installing preperforated casings in well bores. Further objects, features, and advantages of the present invention will be readily apparent to those skilled in the art upon reference to the accompanying drawings and upon reading the following Description of the Preferred Embodiments.

DESCRIPTION OF THE PREFERRED EMBODIMENTS

Figure 1:
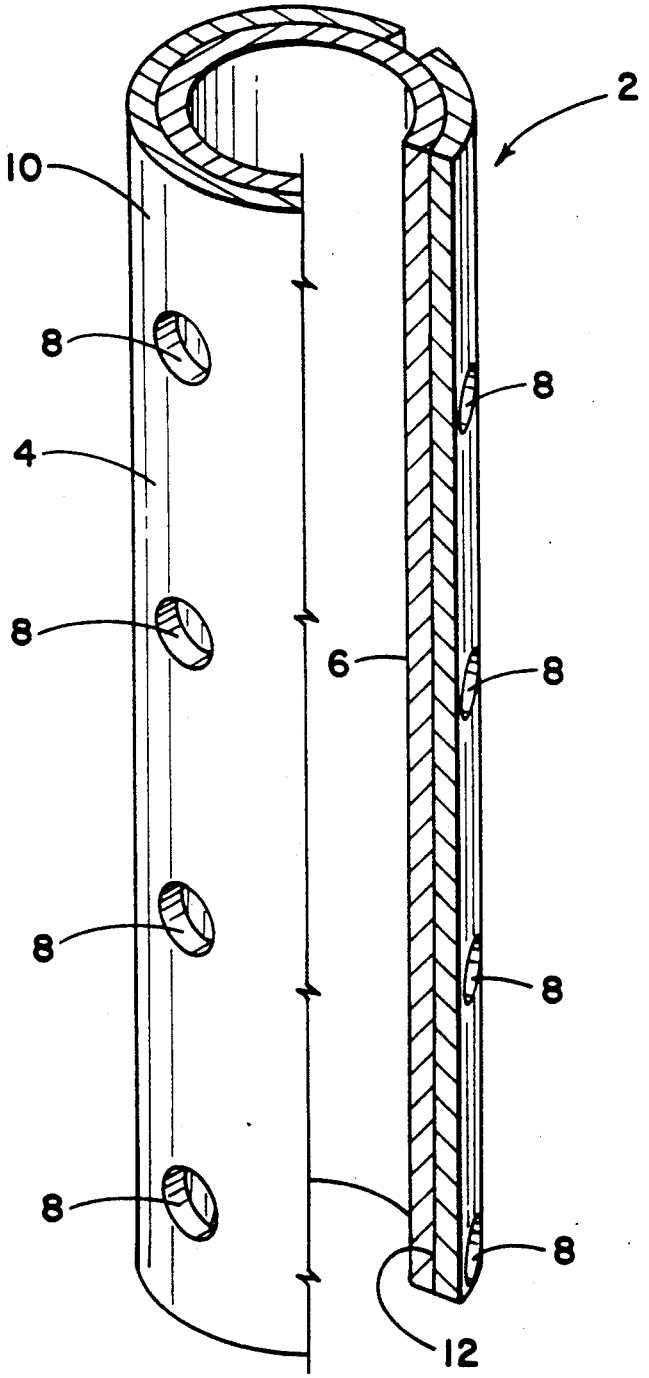
FIG. 1 provides a cutaway perspective view of a portion of an embodiment of the casing 2 of the present invention.
Figure 2:
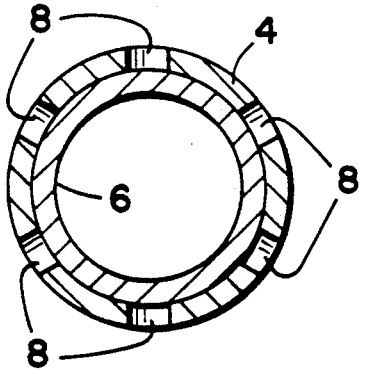
FIG. 2 provides a top cutaway view of inventive casing 2.

An embodiment of the inventive casing 2 is depicted in FIGS. 1 and 2. Casing 2 comprises a tubular conduit 4 and a liner 6 positioned inside conduit 4. Conduit 4 has apertures 8 extending through the wall thereof.

Conduit 4 can generally be formed from any material (e.g., N80 grade steel) which is commonly used for forming oil field well casings. These materials are capable of withstanding the typical temperature, pressure, and chemical conditions existing downhole and are also capable of withstanding the drilling procedures used to remove liner 6 from the interior surface 12 of conduit 4.

As depicted in FIGS. 1 and 2, conduit 4 preferably has a cylindrically-shaped exterior surface 10 and a cylindrically-shaped interior surface 12. Since the well bore into which casing 2 is inserted will generally have a round transverse cross-sectional shape, the cylindrical exterior of casing 2 facilitates the insertion of casing 2 into the well bore and allows a desirably close fit between the wall of the well bore and the exterior surface of casing 2. Due to the cylindrical interior surface 12 of conduit 4, liner 6 can be readily removed from the interior of casing 2 by drilling.

Apertures 8 are formed in conduit 4 before casing 2 is inserted into the well bore. Apertures 8 are also preferably formed in conduit 4 before liner 6 is placed inside conduit 4. Although the apertures 8 shown in FIG. 1 are holes of substantial circular cross section, apertures 8 could be slots or generally any other type of perforation. As will be understood by those skilled in the art, apertures 8 can be formed in conduit 4 using any one of numerous drilling or cutting techniques.

Parameters such as the cross-sectional diameter of conduit 4, the number of apertures placed in conduit 4, and the size of the apertures placed in conduit 4 are determined, primarily, by the production characteristics of the well in question.

In most cases, apertures 8 are formed only in those portions of conduit 4 which, when the inventive casing is finally in place in the well bore, will extend through a producing subterranean formation. Likewise, liner 6 need only cover a sufficient portion of the interior surface of conduit 4 such that liner 6 seals each aperture 8 and thus prevents fluid flow therethrough. With each of the apertures sealed in this manner, all of the fluid pumped down casing 2 during a circulating operation will flow out of the lowermost end of casing 2. Additionally, since liner 6 need only cover a sufficient portion of the interior surface of conduit 4 to seal the apertures 8, liner 6 need not extend over portions of casing 2 wherein casing sections are connected together. Thus, individual sections of the inventive lined casing can be connected with other casing sections and inserted into a well bore in the same manner that common, unperforated casing sections are joined together and inserted into a well bore.

Liner 6 is preferably fixed adjacent the interior surface of conduit 4 so that (a) liner 6 will effectively seal apertures 8 and (b) liner 6 will not shift and/or rotate in conduit 4 while being drilled. Liner 6 can be suitably fixed adjacent the interior surface of conduit 4 by applying an adhesive between the interior surface of conduit 4 and the exterior surface of liner 6, by riveting, or by other means known in the art.

Liner 6 can generally be formed from any material which: is drillable; will remain intact and fixed adjacent the interior surface of conduit 4 when exposed to the temperature, pressure, and chemical conditions existing downhole; will break away from the interior surface of conduit 4 when drilled so that apertures 8 are opened for fluid flow; and will, when drilled, break up into pieces which can be readily circulated out of the well using common circulating fluids.

Preferred liner materials which can be readily circulated out of the well (a) will have material densities which are not significantly greater than the density of the circulating fluid, (b) will most preferably have material densities which are substantially equivalent to (i.e., slightly less than, equal to, or slightly greater than) the density of the circulating fluid, and (c) will, when drilled, break into pieces which are small enough to easily travel through the available flow openings in the well bore annulus. Examples of preferred liner materials include: fiberglass, plastics, lightweight aluminum alloys, ceramics, and the like.

Lined sections of casing 2 can be formed, for example, by: (1) applying an adhesive to the exterior surface of a length of fiberglass or plastic pipe and/or to the interior surface of a preperforated section of casing; (2) inserting the length of pipe into the preperforated casing section such that the length of pipe seals each aperture 8; and (3) allowing the adhesive to cure. The outside diameter of the pipe is preferably such that the exterior surface of the pipe fits snugly against the interior surface of the preperforated casing. Once formed, the lined casing sections are connected with other casing sections (i.e., unperforated casing sections and/or preperforated and lined casing sections, as necessary) to form a casing string which is inserted into the well bore.

Lined sections of casing 2 can also be formed, for example, by extruding a plastic pipe (or liner) onto the interior surface of a preperforated casing section. In this method, an extrusion nozzle, positioned on the end of a long plastic delivery pipe, is placed inside the preperforated casing section at one end thereof and is then moved to the other end of the casing section. As the extrusion nozzle moves through the casing, softened plastic is pumped through the extrusion nozzle to form an extruded pipe or liner within the casing. The extrusion nozzle used in this operation is preferably selected such that a plastic pipe is produced therefrom which expands to fit snugly against (i e , becomes fixed adjacent to) the interior surface of the casing section. If desired, an adhesive can be applied to the interior surface of the casing section prior to forming the extruded pipe or liner therein. Since the softened plastic material leaves the extrusion nozzle in an almost solid state, the plastic material will not fill or plug the perforations of the casing section to any significant degree.

An adhesive used in securing liner 6 to conduit 4 can generally be any adhesive known in the art which (a) is compatible with the liner material and the conduit material and (b) is capable of withstanding the temperature, pressure, and chemical conditions existing downhole.

In one embodiment of the method of the present invention, the preperforated casing of the present invention is run into (i.e., inserted into) an existing well bore. As indicated above, the inventive casing can be run into the well bore using, for example, a conventional method wherein at least one inventive preperforated lined casing section is connected in a casing string with other casing sections. This casing string is then lowered into the well bore by conventional means. As the casing string is lowered into the well bore, a circulating fluid (e.g., a drilling mud or a completion fluid) can be pumped down the casing string and out of the lowermost end thereof in order to clear obstacles that lie in the path of the casing string and to remove debris from the well bore. The casing string can also be rotated, as necessary, to overcome difficult obstacles and tight spots within the well bore. The well bore into which the casing string is run can be a vertical well bore or a high deviation well bore (e.g., a horizontally completed well bore).

Figure 3:
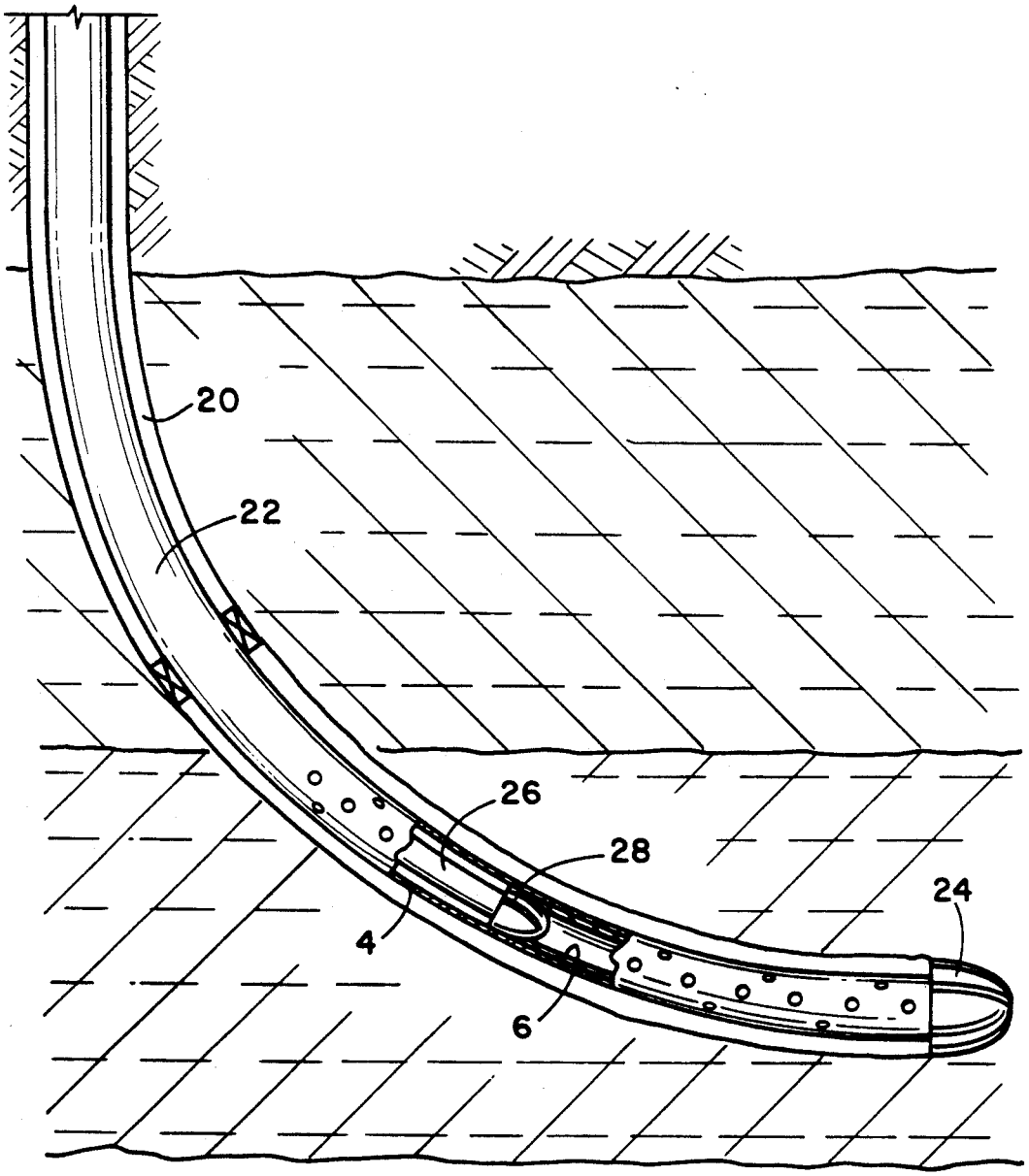
FIG. 3 provides a diagram of the inventive casing and method being used in a horizontally completed well.

In another embodiment of the method of the present invention, the inventive casing is run into a well bore 20 as well bore 20 is being drilled (see FIG. 3). In this embodiment, a casing string 22 including at least one section of inventive casing 2 is assembled in the manner just described. However, a drill bit 24 is connected to the lowermost end of casing string 22 so that the well bore can be drilled as casing string 22 is inserted therein. Casing string 22 thus acts as a drill stem during the drilling operation. In order to operate drill bit 24 and circulate drill cuttings out of the well bore, casing string 22 is rotated, in the same manner as a typical drill string, and a circulating fluid is pumped down casing string 22 and out of drill bit 24. When the drilling process is completed, casing string 22 and drill bit 24 attached thereto are left in the well bore. Drill bit 24 connected to casing string 22 can generally be any drill bit commonly used for drilling a well. If a high deviation well (e.g., a horizontally completed well) is desired, drill bit 24 will preferably be a double acting drill bit of the type described hereinabove.

After the inventive casing is in place in a well bore, a drill string 26 having a drill bit 28 connected at the lower end thereof is lowered into the casing string. The drill string is used to break up (i.e., drill out) the lining 6 of the inventive casing and thus open apertures 8 to permit fluid flow therethrough. As drill bit 28 is drilling through liner 6, a circulating fluid is pumped down drill string 26 and through bit 28 in order to circulate the broken-up pieces of liner 6 out of the casing string. In order to avoid damaging the producing formation, the circulating fluid used to circulate the pieces of liner out of the casing is preferably a solids-free completion fluid.

Examples of drill bits 28 useful for removing liner 6 from the inventive casing include rock bits, polycrystalline diamond compact (PDC) bits and spaded bits. Rock, PDC, or spaded bits modified to allow reverse circulation can also be used to remove liner 6 from inventive casing 2.

Thus, the present invention is well adapted to carry out the objects and obtain the ends and advantages mentioned above, as well as those inherent therein. While numerous changes may be made by those skilled in the art, such changes are encompassed within the scope of the invention as defined by the appended claims.

What is claimed is:

1. A casing for a well comprising:

a conduit having a plurality of apertures extending through the wall thereof, an interior surface, and a cylindrically-shaped exterior surface and a liner fixed adjacent at least a portion of said interior surface such that said liner is positioned adjacent said apertures and said liner is effective for preventing fluid flow through said apertures, said liner being removable by drilling and said liner comprising a material which, upon drilling, will break up into pieces which can be readily circulated out of said well.

2. A casing as described in claim 1 wherein said liner will remain intact and fixed adjacent said portion of said interior surface when exposed to the temperature, pressure, and chemical conditions existing in said well.

3. A casing as described in claim 1 wherein said material is selected from the group of materials consisting of fiberglass, plastic, aluminum alloys, and ceramics.

4. A casing as described in claim 1 wherein said liner is attached to said portion of said interior surface using an adhesive.

5. A casing as described in claim 1 wherein said liner comprises a section of fiberglass pipe.

6. A casing as described in claim 5 wherein said fiberglass pipe is attached to said portion of said interior surface using an adhesive.

7. A casing as described in claim 1 wherein said liner comprises a plastic liner which is deposited on said portion of said interior surface by extrusion.

8. A casing as described in claim 1 wherein said liner comprises a section of plastic pipe.

9. A casing as described in claim 1 wherein said conduit has a first end and wherein said casing further comprises a drilling means, positioned at said first end of said conduit, for drilling said well.

10. A casing as described in claim 9 wherein said drilling means is a means for drilling a high deviation well.

11. A method of installing a perforated casing in a well having a well bore comprising the steps of:

(a) running said perforated casing into said well bore, said perforated casing comprising:

a conduit having a plurality of apertures extending through the wall thereof and an interior surface and a liner fixed adjacent at least a portion of said interior surface such that said liner is positioned adjacent said apertures and said liner is effective for preventing fluid flow through said apertures;

(b) drilling said liner such that said liner is broken up into pieces and said apertures are opened for fluid flow; and (c) circulating said pieces out of said well bore using a circulating fluid.

12. A method as described in claim 11 wherein said conduit has a lower end and said method further comprises the step, prior to step (b), of circulating fluid through said conduit and out of said lower end.

13. A method as described in claim 11 wherein said circulating fluid used in step (c) is a solids-free completion fluid.

14. A method as described in claim 11 wherein said liner is comprised of a material having a density which is substantially equivalent to the density of said circulating fluid.

15. A method as described in claim 14 wherein said material is selected from the group of materials consisting of fiberglass, plastic, aluminum alloys, and ceramics.

16. A method as described in claim 14 wherein said liner is attached to said portion of said interior surface using an adhesive.

17. A method as described in claim 14 wherein said liner comprises a section of fiberglass pipe.

18. A method as described in claim 14 wherein said liner comprises a section of plastic pipe.

19. A method as described in claim 14 wherein said liner comprises a plastic liner which is deposited on said portion of said interior surface by extrusion.

20. A method as described in claim 11 wherein said well bore is a high deviation well bore.

21. A method as described in claim 11 further comprising the step, performed simultaneously with at least a portion of step (a), of drilling said well to form said well bore.

22. A method as described in claim 21 wherein said conduit has a lower end and wherein said perforated casing further comprises a drilling means, positioned adjacent said lower end, for drilling said well to form said well bore.

23. A method as described in claim 22 further comprising the step, performed simultaneously with at least a portion of step (a), of circulating fluid through said conduit and out of said lower end.

24. A method as described in claim 22 wherein said well is a high deviation well and wherein said drilling means is a means for drilling said high deviation well.

25. A method of installing a perforated casing in a well having a high deviation well bore comprising the steps of:

(a) running said perforated casing into said well bore, said perforated casing comprising:
  a conduit having a plurality of apertures extending through the wall thereof and an interior surface and
  a liner fixed adjacent at least a portion of said interior surface such that said liner is positioned adjacent said apertures and said liner is effective for preventing fluid flow through said apertures; and (b) drilling said liner such that said liner is broken up into pieces and said apertures are opened for fluid flow.

26. A method as described in claim 25 wherein said well bore is a horizontally completed well bore.

27. A method as described in claim 26 further comprising the step of circulating said pieces out of said well bore.

28. A method as described in claim 27 wherein said conduit has a lower end and said method further comprises the step, prior to step (b), of circulating fluid through said conduit and out of said lower end.

29. A method as described in claim 27 further comprising the step, conducted simultaneously with at least a portion of step (a), of drilling said well bore.

30. A method as described in claim 29 wherein said conduit has a lower end and wherein said perforated casing further comprises a drilling means, positioned adjacent said lower end, for drilling said horizontally completed well bore.

31. A method as described in claim 30 further comprising the step, performed simultaneously with at least a portion of step (a), of circulating fluid through said conduit and out of said lower end.

* * * * *